United States Patent [19]

Pai et al.

[11] 4,346,158

[45] * Aug. 24, 1982

[54] IMAGING SYSTEM WITH A DIAMINE CHARGE TRANSPORT MATERIAL IN A POLYCARBONATE RESIN

[75] Inventors: Damodar M. Pai; Milan Stolka; John F. Yanus, all of Fairport, N.Y.

[73] Assignee: Xerox Corporation, Stamford, Conn.

[ * ] Notice: The portion of the term of this patent subsequent to May 5, 1998, has been disclaimed.

[21] Appl. No.: 260,496

[22] Filed: May 4, 1981

Related U.S. Application Data

[63] Continuation-in-part of Ser. No. 965,969, Dec. 4, 1978, Pat. No. 4,265,990, which is a continuation-in-part of Ser. No. 793,819, May 4, 1977, abandoned, which is a continuation-in-part of Ser. No. 716,403, Aug. 23, 1976, abandoned.

[51] Int. Cl.[3] ..... G03G 5/00; G03G 5/04

[52] U.S. Cl. ..... 430/59; 430/96

[58] Field of Search ..... 430/59, 70, 58, 96

[56] References Cited

U.S. PATENT DOCUMENTS

| | | | |
|---|---|---|---|
| 3,265,496 | 8/1966 | Fox | 96/1 |
| 3,624,226 | 5/1970 | Hoover et al. | 96/1.5 |
| 3,870,516 | 3/1975 | Smith et al. | 96/1.5 |
| 3,928,034 | 12/1975 | Regensberger | 96/1.5 |
| 3,955,978 | 5/1976 | Rochlitz | 96/1.5 |
| 3,963,779 | 6/1976 | Tsukahara et al. | 260/570 R |
| 4,047,948 | 9/1977 | Horgan | 96/1.5 R |
| 4,265,990 | 5/1981 | Stolka et al. | 430/59 |

FOREIGN PATENT DOCUMENTS

| | | |
|---|---|---|
| 678931 | 1/1964 | Canada . |
| 888109 | 12/1971 | Canada . |
| 932199 | 9/1973 | Canada . |
| 2129087 | 12/1972 | Fed. Rep. of Germany . |
| 1314030 | 11/1962 | France . |
| 2127346 | 9/1972 | France . |
| 2158914 | 5/1973 | France . |
| 2251040 | 6/1975 | France . |
| 1137766 | 12/1968 | United Kingdom . |

*Primary Examiner*—John E. Kittle
*Assistant Examiner*—John L. Goodrow
*Attorney, Agent, or Firm*—Peter H. Kondo; John E. Beck; Ronald Zibelli

[57] ABSTRACT

A photosensitive member having at least two electrically operative layers is disclosed. The first layer comprises an electrically conductive layer. The second layer comprises a charge transport layer. The third layer is a photoconductive layer contiguous with the transport layer. The photoconductive layer is capable of photogenerating and injecting photogenerated holes into the contiguous or adjacent electrically active part. The electrically active material comprises a polycarbonate resin material having dispersed therein from about 25 to 75 percent by weight of one or more compounds having the general formula:

wherein X is selected from the group consisting of an alkyl group having from 1 to about 4 carbon atoms (e.g. methyl, ethyl, propyl, butyl, etc.) and chlorine in the ortho, meta or para position. This structure may be imaged in the conventional xerographic mode which usually includes charging, exposure to light and development.

6 Claims, 4 Drawing Figures

IMAGING SYSTEM WITH A DIAMINE CHARGE TRANSPORT MATERIAL IN A POLYCARBONATE RESIN

CROSS REFERENCE TO RELATED APPLICATIONS

This application is a continuation-in-part application of copending application Ser. No. 965,969, filed Dec. 4, 1978 now U.S. Pat. No. 4,265,990 which in turn is a continuation-in-part application of Ser. No. 793,819, filed May 4, 1977 now abandoned which in turn is a continuation-in-part application of Ser. no. 716,403, filed Aug. 23, 1976 now abandoned.

BACKGROUND OF THE INVENTION

This invention relates in general to xerography and, more specifically, to a novel photoconductive device and method of use.

In the art of xerography, a xerographic plate containing a photoconductive insulating layer is imaged by first uniformly electrostatically charging its surface. The plate is then exposed to a pattern of activating electromagnetic radiation such as light, which selectively dissipates the charge in the illuminated areas of the photoconductive insulator while leaving behind a latent electrostatic image in the non-illuminated areas. This latent electrostatic image may then be developed to form a visible image by depositing finely divided electroscopic marking particles on the surface of the photoconductive insulating layer.

A photoconductive layer for use in xerography may be a homogeneous layer of a single material such as vitreous selenium and alloys of vitreous selenium or it may be a composite layer containing a photoconductor and another material. One type of composite photoconductive layer used in xerography is illustrated by U.S. Pat. No. 3,121,006 which describes a number of layers comprising finely divided particles of a photoconductive inorganic compound dispersed in an electrically insulating organic resin binder. In its present commercial form, the binder layer contains particles of zinc oxide uniformly dispersed in a resin binder and coated on a paper backing.

In the particular examples described in '006, the binder comprises a material which is incapable of transporting injected charge carriers generated by the photoconductor particles for any significant distance. As a result, with the particular material disclosed, the photoconductor particles must be, in substantially continuous particle-to-particle contact throughout the layer in order to permit the charge dissipation required for cyclic operation. Therefore, with the uniform dispersion of photoconductor particles described, a relatively high volume concentration of photoconductor, about 50 percent by volume, is usually necessary in order to obtain sufficient photoconductor particle-to-particle contact for rapid discharge. However, it has been found that high photoconductor loadings in the binder results in the physical continuity of the resin being destroyed, thereby significantly reducing the mechanical properties of the binder layer. Systems with high photoconductor loadings are often characterized as having little or no flexibility. On the other hand, when the photoconductor concentration is reduced appreciably below about 50 percent by volume, the photo-induced discharge rate is reduced, making high speed cyclic or repeated imaging difficult or impossible.

U.S. Pat. No. 3,037,861 to Hoegl et al teaches that poly(N-vinylcarbazole) exhibits some long-wave length U.V. sensitivity and suggests that its spectral sensitivity can be extended into the visible spectrum by the addition of dye sensitizers. The Hoegl et al patent further suggests that other additives such as zinc oxide or titanium dioxide may also be used in conjunction with poly(N-vinylcarbazole). In the Hoegl et al patent, the poly(N-vinylcarbazole) is intended to be used as a photoconductor, with or without additive materials which extend its spectral sensitivity.

In addition to the above, certain specialized layered structures particularly designed for reflex imaging have been proposed. For example, U.S. Pat. No. 3,165,405 to Hoesterey utilizes a two-layered zinc oxide binder structure for reflex imaging. The Hoesterey patent utilizes two separate contiguous photoconductive layers having different spectral sensitivities in order to carry out a particular reflex imaging sequence. The Hoesterey device utilizes the properties of multiple photoconductive layers in order to obtain the combined advantages of the separate photoresponse of the respective photoconductive layers.

It can be seen from a review of the conventional composite photoconductive layers cited above, that upon exposure to light, photoconductivity in the layered structure is accomplished by charge transport through the bulk of the photoconductive layer, as in the case of vitreous selenium (and other homogeneous layered modifications). In devices employing photoconductive binder structures which include inactive electrically insulating resins such as those described in the '006 patent, conductivity or charge transport is accomplished through high loadings of the photoconductive pigment and allowing particle-to-particle contact of the photoconductive particles. In the case of photoconductive particles dispersed in a photoconductive matrix, such as illustrated by U.S. Pat. No. 3,121,007, photoconductivity occurs through the generation and transport of charge carriers in both the photoconductive matrix and the photoconductor pigment particles.

Although the above patents rely upon distinct mechanisms of discharge throughout the photoconductive layer, they generally suffer from common deficiencies in that the photoconductive surface during operation is exposed to the surrounding environment, and particularly in the case of repetitive xerographic cycling where these photoconductive layers are susceptible to abrasion, chemical attack, heat and multiple exposure to light. These effects are characterized by a gradual deterioration in the electrical characteristics of the photoconductive layer resulting in the printing out of surface defects and scratches, localized areas of persistent conductivity which fail to retain an electrostatic charge, and high dark discharge. Some photoconductive materials, however, are relatively durable and can provide good images for many thousands of cycles.

In addition to the problems noted above, these photoreceptors require that the photoconductor comprise either a hundred percent of the layer, as in the case of the vitreous selenium layer or that they preferably contain a high proportion of photoconductive material in the binder configuration. The requirements of a photoconductive layer containing all or a major proportion of a photoconductive material further restricts the physical characteristics of the final plate, drum or belt in that the physical characteristic such as flexibility and adhesion of the photoconductor to a supporting substrate are primarily dictated by the physical properties of the photoconductor, and not by the resin or matrix material which is preferably present in a minor amount. Generally, a thin layer of photoconductive material is more flexible than a thick layer.

Another form of a composite photosensitive layer which has also been considered by the prior art includes a layer of photoconductive material which is covered with a relatively thick plastic layer and coated on a supporting substrate.

U.S. Pat. No. 3,041,166 to Bardeen describes such a configuration in which a transparent plastic material overlies a layer of vitreous selenium which is contained on a supporting substrate. In operation, the free surface of the transparent plastic is electrostatically charged to a given polarity. The device is then exposed to activating radiation which generates hole electron pairs in the photoconductive layer. The electrons move thorugh the plastic layer and neutralize positive charges on the free surface of the plastic layer thereby creating an electrostatic image. Bardeen, however, does not teach any specific plastic materials which will function in this manner, and confines his examples to structures which use a photoconductor material for the top layer.

U.S. Pat. No. 3,598,582 to Herrick et al describes a special purpose composite photosensitive device adapted for reflex exposure by polarized light. One embodiment which employs a layer of dichroic organic photoconductive particles arrayed in oriented fashion on a supporting substrate and a layer of poly(N-vinylcarbazole) formed over the oriented layer of dichroic material. When charged and exposed to light polarized perpendicular to the orientation of the dichroic layer, the oriented dichroic layer and poly(N-vinylcarbazole) layer are both substantially transparent to the initial exposure light. When the polarized light hits the white background of the document being copied, the light is depolarized, reflected back through the device and absorbed by the dichroic photoconductive material. In another embodiment, the dichroic photoconductor is dispersed in oriented fashion throughout the layer of poly(N-vinylcarbazole).

Belgium Pat. No. 763,540, issued Aug. 26, 1971, discloses an electrophotographic member having at least two electrically operative layers. The first layer comprises a photoconductive layer which is capable of photogenerating charge carries and injecting the photogenerated holes into a contiguous active layer. The active layer comprises a transparent organic material which is substantially nonabsorbing in the spectral region of intended use, but which is "active" in that it allows injecting of photogenerated holes from the photoconductive layer, and allows these holes to be transported through the active layer. The active polymers may be mixed with inactive polymers or nonpolymeric material.

Gilman, Defensive Publication of Ser. No. 093,449 filed Nov. 27, 1970, published in 888 O.G. 707 on July 20, 1970, Defensive Publication No. P888.013, U.S. Cl. 96/1.5, discloses that the speed of an inorganic photoconductor such as amorphous selenium can be improved by including an organic photoconductor in the electrophotographic element. For example, an insulating resin binder may have $TiO_2$ dispersed therein or it may be a layer of amorphous selenium. This layer is overcoated with a layer of electrically insulating binder resin having an organic photoconductor such as 4,4'-diethylamino-2,2'-dimethyltriphenylmethane dispersed therein.

"Multi-Active Photoconductive Element", Martin A. Berwick, Charles J. Fox and William A. Light, Research Disclosure, Vol. 133; pages 38–43, May 1975, was published by Industrial Opportunities, Ltd., Homewell, Havant, Hampshire, England. This disclosure relates to a photoconductive element having at least two layers comprising an organic photoconductor containing a charge transport layer in electrical contact with an aggregate charge generation layer. Both the charge generation layer and the charge transport layer are essentially organic compositions. The charge generation layer contains a continuous, electrically insulating polymer phase and a discontinuous phase comprising a finely divided, particulate cocrystalline complex of (1) at least one polymer having an alkylidene diarylene group in a recurring unit and (2) at least one pyrylium-type dye salt. The charge transport layer is an organic material which is capable of accepting and transporting injected charge carriers from the charge generation layer. This layer may comprise an insulating resinous material having 4,4'-bis(diethylamino)-2,2'-dimethyltriphenylmethane dispersed therein.

U.S. Pat. No. 3,265,496, discloses that N,N,N',N'-tetraphenylbenzidine may be used as photoconductive material in electrophotographic elements. This compound is not sufficiently soluble in the resin binders of the instant invention to permit a sufficient rate of photoinduced discharge.

Straughan, U.S. Pat. No. 3,312,548, in pertinent part, discloses a xerographic plate having a photoconductive insulating layer comprising a composition of selenium, arsenic and a halogen. The halogen may be present in amounts from about 10 to 10,000 parts per million. This patent further discloses a xerographic plate having a support, a layer of selenium and an overlayer of a photoconductive material comprising a mixture of vitreous selenium, arsenic and a halogen. Other dual and even triplelayer structures of various selenium alloy combinations have also been developed to achieve a desired performance. For example, U.S. Pat. No. 2,803,541 to Paris teaches that a thin layer of a selenium-tellurium alloy overcoated on selenium improves its sensitivity. U.S. Pat. No. 3,655,377 issued to Sechak teaches the use of a three layer structure of selenium alloys.

The compound of the instant invention is represented by the formula:

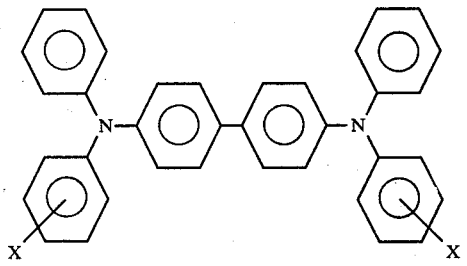

wherein X is selected from the group consisting of an alkyl group having from 1 to about 4 carbon atoms (e.g. methyl, ethyl, propyl, isopropyl, isobutyl, tert-butyl, n-butyl, etc.) and chlorine in the ortho, meta or para position, and it is dispersed in a polycarbonate resin in order to form a charge transport layer for a multi-layered device comprising a charge generation layer and a charge transport layer. The charge transport layer may but need not necessarily be substantially nonabsorbing in the spectral region of intended use, but must be "active" in that it allows injection of photoexcited holes from the photoconductive layer, i.e., the charge generation layer, and allows these holes to be transported through the charge transport layer.

Most organic charge transporting layers using active materials dispersed in organic binder materials have been found to trap charge carriers causing an unacceptable buildup of residual potential when used in a cyclic mode in electrophotography. Also, most organic charge transporting materials known when used in a layered configuration contiguous to a charge generating layer have been found to trap charge at the interface between the two layers. This results in lowering the potential differences between the illuminated and non-illuminated regions when these structures are exposed to an image. This, in turn, lowers the print density of the end product, i.e., the electrophotographic copy.

Another consideration which is necessary in the system is the glass transition temperature ($T_g$). The ($T_g$) of the transport layer has to be substantially higher than the normal operating temperatures. Many organic charge transporting layers using active materials dispersed in organic binder material have unacceptably low ($T_g$) at loadings of the active material in the organic binder material which is required for efficient charge transport. This results in the softening of the layer, which in turn, may become susceptible to impaction of dry developers and toners. Another unacceptable feature of a low ($T_g$) is the case of leaching or exudation of the active materials from the organic binder material resulting in degradation of charge transport properties from the charge transport layer. Another deficiency of the low ($T_g$) layers is the susceptility to crystallization resulting from increased diffusion rates of the small molecules.

Another consideration for the use of organic transport layers in electrophotography is the value of the charge carriers mobilities. Most of the organics known to date are deficient in this respect in that they set a limit to the cyclic speed of the system employing the same.

It was found that one or a combination of compounds within the general formula:

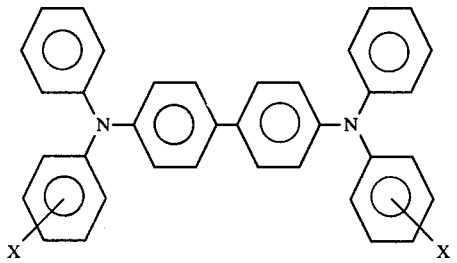

as defined above, dispersed in a polycarbonate resin, transports charge very efficiently without any trapping when this layer is used contiguous with a generation layer and subjected to charge/light discharge cycles in an electrophotographic mode. There is no buildup of the residual potential over many thousands of cycles. The charge carrier mobilities are sufficiently high to permit the highest speed cyclic performance in electrophotography.

The above described small molecules due to the presence of solubilizing groups, such as, methyl or chlorine are substantially more soluble in the polycarbonate resin binders described herein whereas unsubstituted tetraphenyl benzidine is not sufficiently soluble in these binders.

Furthermore, when the diamines of the instant invention, dispersed in a polycarbonate binder, are used as transport layers contiguous a charge generation layer, there is no interfacial trapping of the charge photogenerated in and injected from the generating layer.

Furthermore, diamines of the instant invention dispersed in a polycarbonate binder were found to have sufficiently high ($T_g$) even at high loadings, thereby eliminating the problems associated with low ($T_g$) as discussed above.

None of the above-mentioned art overcomes the above-mentioned problems. Furthermore, none of the above-mentioned art discloses specific charge generating material in a separate layer which is contiguous with a charge transport layer comprising a polycarbonate resin matrix material having dispersed therein the diamines of the instant invention. The charge transport material may, but need not necessarily be, substantially nonabsorbing in the spectral region of intended use. However, the charge transport material is "active" in that it allows injection of photogenerated holes from the charge generation layer and allows these holes to be transported therethrough. The charge generating layer is a photoconductive layer which is capable of photogenerating and injecting photogenerated holes into the contiguous charge transport layer.

It has also been found that when an alloy of selenium and arsenic containing a halogen is used as a charge carrier generation layer in a multilayered device which contains a contiguous charge carrier transport layer, the member, as a result of using this particular charge generation layer, has unexpectedly high contrast potentials as compared to similar multilayered members employing other generating layers. Contrast potentials are important characteristics which determine print density. Excellent contrast potentials are also achieved with alloys of selenium which are free of halogen.

OBJECTS OF THE INVENTION

It is an object of this invention to provide a novel photoconductive device adapted for cyclic imaging which overcomes the above-noted disadvantages.

It is another object of this invention to provide a novel imaging member capable of remaining flexible while still retaining its electrical properties after extensive cycling and exposure to the ambient, i.e., oxygen, ultraviolet radiation, elevated temperatures, etc.

It is another object of this invention to provide a novel imaging member which has no bulk trapping of charge upon extensive cycling.

SUMMARY OF THE INVENTION

The foregoing objects and others are accomplished in accordance with this invention by providing a photoconductive member having at least three operative layers. The first layer comprises an electrically conductive layer. The second layer comprises a charge transport layer. The third layer is a photoconductive layer contiguous with the transport layer. The photoconductive layer is capable of photogenerating and injecting photogenerated holes into the contiguous or adjacent electrically active layer. The electrically active material comprises a polycarbonate resin material having dispersed therein from about 25 to about 75 percent by weight of one or more compounds having the general formula:

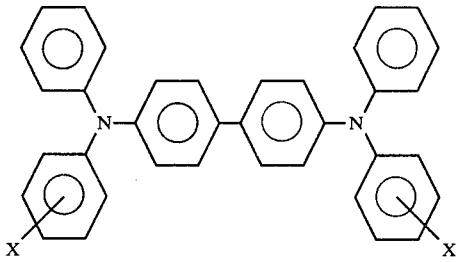

as defined above. The compound may be named N,N'-diphenyl-N,N'-bis(alkylphenyl)-[1,1'-biphenyl]-4,4'-diamine wherein the alkyl is, for example, methyl, ethyl, propyl, n-butyl, etc. or the compound may be N,N'-diphenyl-N,N'-bis(chlorophenyl)-[1,1'-biphenyl]-4,4'-diamine. The charge transport layer need not be substantially nonabsorbing to visible light or radiation in the region of intended use but is "active" in that it allows the injection of photogenerated holes from the photoconducitve layer, i.e., charge generation layer, and allows these holes to be transported through the active charge transport layer to selectively discharge surface charges on the surface of the charge generation layer.

It was found that, unlike the prior art, when the diamines of the instant invention were dispersed in a polycarbonate binder, this layer transports charge very efficiently without any trapping of charges when subjected to charge/light discharge cycles in an electrophotographic mode. There is no buildup of the residual potential over many thousands of cycles.

Furthermore, the transport layers comprising the diamines of the instant invention dispersed in a polycarbonate binder were found to have sufficiently high ($T_g$) even at high loadings thereby eliminating the problems associated with low ($T_g$). The prior art suffers from this deficiency.

Furthermore, no deterioration in charge transport was observed when these transport layers were subjected to ultraviolet radiation encountered in its normal usage in a xerographic machine environment.

Therefore, when members containing charge transport layers of the instant invention are exposed to ambient conditions, i.e., oxygen, U.V. radiation, etc., these layers remain stable and do not lose their electrical properties. Furthermore, the diamines of the instant invention do not crystallize and become insoluble in the polycarbonate resinous material into which these materials were originally dispersed. Therefore, since the diamines of the instant invention do not appreciably react with oxygen or are not affected by U.V. radiation, encountered in their normal usage in a xerographic machine environment, then when combined with a polycarbonate resin, it allows acceptable injection of photogenerated holes from the photoconductor layer, i.e., charge generation layer, and allows these holes to be transported repeatedly through the active layer sufficiently to acceptably discharge a surface charge on the free surface of the charge generation layer in order to form an acceptable electrostatic latent image.

As mentioned, the foregoing objects and others may be accomplished in accordance with this invention by providing a specifically preferred photoconductive member having at least three operative layers. The charge generation layer being a preferred specie which consists essentially of a mixture of amorphous selenium, arsenic and a halogen. Arsenic is present in amounts from about 0.5 percent to about 50 percent by weight and the halogen is present in amounts from about 10 to about 10,000 parts per million with the balance being amorphous selenium. This layer is capable of photogenerating and injecting photogenerated holes into a contiguous or adjacent charge transport layer. The charge transport layer consists essentially of a polycarbonate resinous material having dispersed therein from about 25 to about 75 percent by weight of the diamines of the instant invention.

"Electrically active" when used to define the charge transport layer material means that the material is capable of supporting the injection of photogenerated holes from the charge generation layer material and capable of allowing the transport of these holes thorugh the electrically active layer in order to discharge surface charges on the charge generation layer.

"Electrically inactive" when used to describe the organic material which does not contain any diamine of the instant invention means that the material is not capable of supporting the injection of photogenerated holes from the generating material and is not capable of allowing the transport of these holes through the organic material.

It should be understood that the polycarbonate resinous material which becomes electrically active when it contains from about 25 to about 75 percent by weight of the diamine does not function as a photoconductor in the wavelength region of intended use. As stated above, hole electron pairs are photogenerated in the photoconductive layer and the holes are then injected into the active layer and hole transport occurs through this active layer.

A typical application of the instant invention involves the use of a layered configuration member which in one embodiment comprises a supporting substrate, such as an electric conductor, containing a charge transport layer and a photoconductive layer thereon. For example, the photoconductive layer may be in the form of amorphous selenium or amorphous alloys of selenium such as selenium-arsenic, selenium-telluriumarsenic and selenium-telurium. The selenium alloy photoconductive layer is coated over the charge transport layer of electrically inactive polycarbonate resinous material, having dispersed therein from about 25 percent to about 75 percent by weight of the diamine. This structure can then be imaged in the conventional xerographic manner which usually includes charging, optical exposure and development.

As mentioned, when an alloy of selenium and arsenic containing a halogen of the instant invention is used as a charge carrier generation layer in a multilayered device which contains a contiguous charge carrier transport layer, the member, as a result of using this particular charge generation layer has unexpectedly high contrast potentials as compared to similar multilayered members using different generator layer materials.

In general, the advantages of the improved structure and method of imaging will become apparent upon consideration of the following disclosure of the invention, especially when taken in conjunction with the accompanying drawings wherein:

DETAILED DESCRIPTION OF THE DRAWINGS

Figure 1:
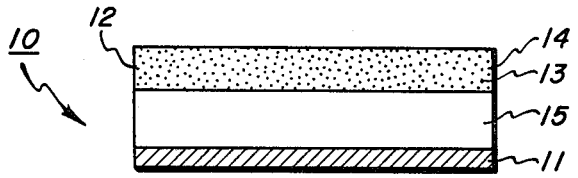
FIG. 1 is a schematic illustration of one embodiment of a device of the instant invention.

In the drawings, FIGS. 1–4 represent several variations of photoreceptor plates within the scope of the invention. They are all basically similar in that they comprise a conductive substrate, a charge transport layer thereon and a charge generation layer over the transport layer.

In FIG. 1, photoreceptor 10 consists of a substrate 11; a charge transport layer 15 comprising a transparent electrically inactive polycarbonate resin having dissolved therein one or more of the diamines defined above, and a charge generator layer 12 comprising photoconductive particles 13 dispersed randomly in an electrically insulting organic resin 14.

Figure 2:
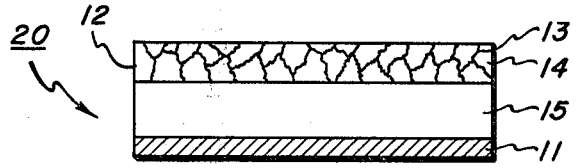
FIG. 2 illustrates a second embodiment of the device for the instant invention.

In FIG. 2, photoreceptor 20 differs from FIG. 1 in the charge generator layer 12. Here the photoconductive particles are in the form of continuous chains through the thickness of the binder material 14. The chains constitute a multiplicity of interlocking photoconductive continuous paths through the binder material. The photoconductive paths are present in a volume concentration of from about 1 to 25 percent based on the volume concentration of said layer.

Figure 3:
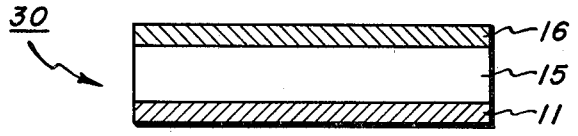
FIG. 3 illustrates a third embodiment of the device of the instant invention.

In FIG. 3, photoreceptor 30 differs from FIGS. 1 and 2 in that charge generator layer 16 comprises a homogeneous photoconductive layer 16.

Figure 4:
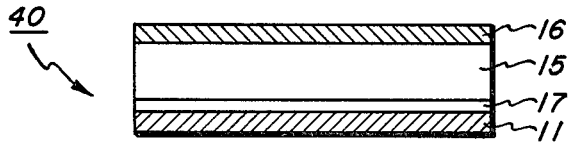
FIG. 4 illustrates a fourth embodiment of the device of the instant invention.

In FIG. 4, photoreceptor 40 differs from FIG. 3 in that an adhesive layer 17 is employed at the substrate transport layer interface. the adhesive layer functions to improve, where desired, adhesion between the substrate and the charge transport layer. Any suitable adhesive material may be used, e.g. low molecular weight polyester, poly-vinyl butyral, and the like.

In the devices of the present invention the substrate 11 may be of any suitable electrically conductive material, e.g. aluminum, steel, brass, graphite, dispersed conductive salts, conductive polymers or the like. The substrate may be rigid or flexible, and of any conventional thickness. Typical substrate forms include flexible belts or sleeves, sheets, webs, plates, cylinders and drums. The substrate may also comprise a composite structure such as thin conductive layer, such as aluminum or copper iodide, or glass coated with a thin conductive coating of chromium or tin oxide. Particularly preferred as substrates are metallized polyesters, such as aluminized polyester.

The photoconductive material which may be the particles 13 of FIGS. 1 and 2 or the homogeneous layer 16 of FIGS. 3 and 4 may consist of any suitable inorganic or organic photoconductor and mixtures thereof. The photoconductive layer which is employed in conjunction with the active transport layer in the instant invention is a material which is an insulator to the extent that the positive electrostatic charge placed on said photoconductive layer is not conducted in the absence of illumination, i.e., with a rate sufficient to prevent the formation and retention of an electrostatic latent image thereon. If desired, the photoconductive layer may comprise two or more layers of different photoconductive materials. The combination of a pluraity of photoconductive layers should, however, be capable of photogenerating holes and injecting photogenerated holes into the transport layer. Inorganic materials include inorganic crystalline photoconductive compounds and inorganic photoconductive glasses. Typical inorganic compounds include cadmium sulfoselenide, cadmium selenide, cadmium sulfide and mixtures thereof. Typical inorganic photoconductive glasses include amorphous selenium and selenium alloys such as selenium-tellurium, selenium-tellurium-arsenic and selenium-arsenic and mixtures thereof. Selenium may also be used in a crystalline form known as trigonal selenium.

Typical organic photoconductive materials which may be used as charge generators in the charge generation layer include phthalocyanine pigment such as the X-form of metal-free phthalocyanine described in U.S. Pat. No. 3,357,989 to Byrne et al; metal phthalocyanines such as copper phthalocyanine; quinacridones available from DuPont under the tradename Monastral Red, Monastral Violet and Monastral Red Y; substituted 2,4-diamine-triazines disclosed by Weinberger in U.S. Pat. No. 3,445,227; triphenodioxazines disclosed by Weinberger in U.S. Pat. No. 3,442,781; polynuclear aromatic quinones available from Allied Chemical Corporation under the tradename Indofast Double Scarlet, Indofast Violet Lake B, Indofast Brilliant Scarlet and Indofast Orange.

Intermolecular charge transfer complexes such as a mixture of poly(N-vinylcarbazole) (PVK) and trinitrofluorenone (TNF) may be used as charge generating materials. These materials are capable of injecting photogenerated holes into the transport material.

Additionally, intramolecular charge transfer complexes may be used as charge generation materials capable of injecting photogenerated holes into the transport materials.

A method of making a photosensitive member which utilizes trigonal selenium comprises forming a dispersion of finely divided vitreous selenium particles in a liquid organic resin solution and then coating the solution onto a supporting substrate and drying to form a binder layer comprising vitreous selenium particles contained in an organic resin matrix. Then the member is heated to an elevated temperature, e.g., 100° C. to 140° C. for a sufficient time, e.g., 8 to 24 hours, which converts the vitreous selenium to the crystalline trigonal form. Similarly, finely divided trigonal selenium particles dispersed in an organic resin solution can be coated onto a charge transport layer and dried to form a generator binder layer.

Another embodiment is a 0.2 micron thick charge generation layer of 35.5 percent by weight arsenic, 64.5 percent by weight amorphous selenium and 850 parts per million iodine. This charge generation layer may be coated on a 30 micron thick charge transport layer of Makrolon$^R$, a polycarbonate resin, which has dispersed therein 40 percent by weight of the diamine of the instant invention.

The above list of photoconductors should in no way be taken as limiting, but merely illustrative as suitable materials. The size of the photoconductive particles is not particularly critical; but particles in a size range of about 0.01 to 5.0 microns yield particularly satisfactory results.

Binder material 14 may comprise any electrically insulating resin such as those described in the abovementioned Middleton et al U.S. Pat. No. 3,121,006. When using an electrically inactive or insulating resin, it is essential that there be particle-to-particle contact between the photoconductive particles. This necessitates that the photoconductive material be present in an amount of at least about 10 percent by volume of the binder layer with no limitation on the maximum amount of photoconductor in the binder layer. If the matrix or binder comprises an active material, the photoconductive material need only to comprise about 1 percent or less by volume of the binder layer with no limitation on the maximum amount of the photocoductor in the binder layer. The thickness of the photoconductive layer is not critical. Layer thickness from about 0.05 to 20.0 microns have been found satisfactory, with a preferred thickness of about 0.05 to 5.0 microns yielding good results.

Another embodiment is where the photoconductive material may be particles of amorphous selenium-arsenic as shown as particles 13 which may comprise from about 0.5 percent to about 50 percent by weight arsenic and the halogen may be present in amounts up to 10,000 parts per million with the balance being selenium. The arsenic preferably may be present from about 20 percent to about 40 percent by weight with 35.5 percent by weight being the most preferred. The most preferred halogen is iodine. The remainder of the alloy or mixture is preferably selenium. The photoconductor should be responsive to all wavelengths from 4,000 to 8,000 angstrom units if panchromatic responses are required. All photoconductor-active material combinations of the instant invention result in the injection and subsequent transport of holes across the physical interface between the photoconductor and the active material.

The change generator layer may be applied to the charge transport layer by any suitable known technique such as by vacuum deposition, spraying, knife coating and the like.

Active layer 15 comprises an electrically inactive polycarbonate resinous material having dispersed therein from about 25 to 75 percent by weight of one or more of the diamines defined above.

In general, the thickness of active layer 15 would be from about 5 to 100 microns, but thicknesses outside this range can also be used.

The preferred polycarbonate resins for the transport layer have a molecular weight from about 20,000 to about 120,000, more preferably from about 50,000 to about 120,000.

The materials most preferred as the electrically inactive resinous material are poly(4,4'-isopropylidene-diphenylene carbonate) having molecular weights of from bout 25,000 to about 40,000 available as Lexan®145, and from about 40,000 to about 45,000, available as Lexan®141, both from the General Electric Company; and from about 50,000 to about 120,000, available as Makrolon®, from Farbenfabricken Bayer A. G.; and from about 20,000 to about 50,000, available as Merlon®, from Mobay Chemical Company.

The photosensitive member of the instant invention possess numerous advantages over other material combinations. For example, it is found that when vitreous selenium alloys are vapor deposited on top of charge transport layers of some small molecules such as bis(4-diethylamino-2-methylphenyl) phenyl methane in a binder, charges photogenerated in the selenium alloys are not efficiently photoinjected into the transport layer. Presumably, this is due to some chemical interaction between the selenium alloys (when vapor deposited on top of the transport layer) and the small molecules and, thus, some small molecules and binder combinations fail to discharge efficiently. However, no chemical interaction and therefore no performance limitations have been observed when selenium alloys are vapor deposited on small molecule transport layers such as N,N'-diphenyl-N,N'-bis(3-methyl phenyl)-[1,1'-biphenyl]-4,4'-diamine dispersed in polycarbonate. Since the photosensitive member of this invention is charged with a positive charge and since the charge transport layer is a donor type material, electron injection through the charge transport layer is not possible. Thus, blocking layers may be eliminated. Since electrons are not transported through the charge transport layer, the choice of conductive material is not limited by injection considerations and therefore the choice of conductive materials is extensive as described above. An adhesive layer might, with some materials, be desirable to promote adhesion between the transport layer and the conductive layer but the material requirement is not particularly critical since the adhesive layer does not serve any electrical function.

The development density of an image is driven by the electric field above the photosensitive member. The development field above the photosensitive member is a function of the charging field across the photoreceptor. Therefore, for efficient operation, the photoreceptor has to be charged to as high a field as possible. The upper limit to the charging fields of the photosensitive member is determined by injection from the conductive layer. If a blocking layer is used to minimize injection, injection from weak spots in the blocking layer creates a background problem known as powder deficient spots. The photosensitive member of this invention eliminates any need for a blocking layer and can be charged to extremely high fields with out encountering a powder deficient spot problem. This results from inability to transport electrons through the charge transport layer containing the diamine of the instant invention in polycarbonate.

Amorphous selenium alloys crystallize when heated to temperatures above their glass transition temperature. Therefore a photosensitive member comprising a selenium alloy sandwiched between a conductive layer and a transport layer has an upper temperature limit to which the structure can be heated to remove the solvent from the transport layer. Solvent removal is essential to insure the long-term cyclic and mechanical stability of the photosensitive member. The solvent is efficiently removed when the transport layer is heated to temperatures above the glass transition temperature of about 80° C. to about 120° C. of the transport layer. At these temperatures generator layer of low arsenic alloys would crystallize and would have different electrical and mechanical properties. However, in photosensitive members in which the transport layer is sandwiched between a conductive layer and alloy layer, the alloy layer is vapor deposited after the solvent removal step and would be unaffected by the heat employed during the previous solvent removal step.

In structures where the charge generation layer is sandwiched between an opaque conductive layer and a charge transport layer, the transport layer must be transparent so that most of the incident exposure is absorbed in the charge generation layer. This transparency requirement restricts the type of binder that can be employed. A stucture having the charge transport layer sandwiched between a conductive layer and a charge generation layer can be employed with front exposure systems even when the small molecule and binder combination is colored or even opaque. Some binders form a charge transfer complex with the small molecule and these can be employed in structures having an external charge generation layer. The photosensitive members of this invention may comprise flexible structures such as a thin layer of selenium alloy vapor deposited on top of a charge transport layer supported by a conductive layer or it may comprise a rigid member such as a thick selenium alloy having a thickness between about 15 microns and about 60 microns, overcoated on a thin transport layer between about 1,000 A° to about 2 microns supported by a conductive layer. In this case when the photosensitive member is charged positively the thin charge transport layer may function as both an electron blocking layer and also as a transport layer for the holes accumulated at the interface between the charge generation layer and the charge transport layer. In this case the charge transport layer acts as an "active" barrier layer.

Specific examples illustrating techniques for preparation of suitable materials for any given layer are further described in copending parent application, Ser. No. 965,969, filed Dec. 4, 1978, the entire disclosure of said parent application being incorporated herein by reference.

The following examples further define the present invention with respect to methods of making and using a photosensitive member. The percentages are by weight unless otherwise indicated. The examples below are intended to illustrate various preferred embodiments of the present invention. Examples I, III and V through X show how to prepare the diamines of the instant invention. Examples II, IV, and XI demonstrate the solubility of the diamines of the instant invention in polycarbonate. Examples XII and XIII show the solubility of a diamine disclosed in U.S. Pat. No. 3,265,496 in polycarbonate. Examples XIV and XV below illustrate and compare photosensitive members utilizing a small molecule and binder layer of bis(4-diethylamino-2-methyl phenyl) phenyl methane in polycarbonate. The charge generation layer is amorphous selenium. Example XIV deals with an external transport layer system and Example XV deals with an external generation layer system. It is known that the photosensitive member in Example XIV is an efficient device whereas destructive interaction is believed to occur between selenium and the transport layer in the structure of Example XV. Example XVI illustrates the instant invention wherein a charge transport layer contains a diamine of the instant invention dispersed in polycarbonate. The charge generation layer is amorphous selenium and the transport layer is sandwiched between the charge generator layer and a conductive layer. The photosensitive device performs very efficiently. Example XVII also illustrates the instant invention employing a charge transport layer of N,N'-diphenyl-N,N'-bis(3-methylphenyl)-[1,1'-biphenyl]-4,4'-diamine dispersed in polycarbonate. The charge generation layer is an alloy of arsenic and selenium and the photosensitive member has a charge transport layer sandwiched between a charge generation layer and the conductive substrate. This device also performs very efficiently.

EXAMPLE I

Preparation of N,N'-diphenyl-N,N'-bis(3-methylphenyl)-[1,1'-biphenyl]-4,4'-diamine In a 5000 milliliter, round bottom, 3 necked flask fitted with a mechanical stirrer and blanketed with argon, is placed 336 grams (1 mole) of N,N'-diphenyl-[1,1'-biphenyl]-4,4'-diamine, 550 grams (2.5 moles) of m-iodotoluene, 550 grams (4 moles) potassium carbonate (anhydrous) and 50 grams of copper bronze catalyst and 1500 ml dimethylsulfoxide (anhydrous). The heterogeneous mixture is refluxed for 6 days. The mixture is allowed to cool. 2000 ml of benzene is added. The dark slurry is then filtered. The filtrate is extracted 4 times with water. Then the filtrate is dried with magnesium sulfate and filtered. The benzene is taken off under reduced pressure. The black product is column chromatographed using Woelm neutral alumina. Colorless crystals of the product are obtained by recrystallizing the product from n-octane. The melting point is 167°–169° C. The yield is 360 grams (65%).

Analytical Calculation for $C_{38}H_{32}N_2$: C, 88.34; H, 6.24; N, 5.37. Found: C, 88.58; H, 6.21; N, 5.37.

NMR ($CDCl_3$) δ2.23 (s, 6, methyl); 6.60–7.47 ppm (m, 26, aromatics).

EXAMPLE II

Preparation of a Solution Employing the Compound of Example I

A charge transport layer is prepared by dissolving in 135 grams of methylene chloride, 3.34 grams of N,N'-diphenyl-N,N'-bis(3-methylphenyl)[1,1'-biphenyl]-4,4'-diamine as prepared in Example I and 10 grams of bisphenol-A-polycarbonate (Lexan ®145, obtained from General Electric Company). A layer of the above mixture is formed on the vitreous selenium layer using a Bird Film Applicator. The coating is then vacuum dried at 40° C. for 18 hours to form a 22 micron thin dry layer of charge transport material.

EXAMPLE III

Preparation of N,N'-diphenyl-N,N'-bis(4-methylphenyl)-[1,1'-biphenyl]-4,4'-diamine A 500 ml, three necked, round bottom flask, equipped with a magnetic stirrer and purged with argon, was charged with 20 grams of p,p'-diiodo-biphenyl (0.05 mole), 18.3 grams of p-tolylphenyl-amine (0.1 mole), 20.7 grams potassium carbonate (anhydrous) (0.15 mole), 3.0 grams of copper powder and 50 mls of sulfolane (tetrahydrothiophene-1,1-dioxide). The mixture was heated to 220°–225° C. for 24 hours, allowed to cool to approximately 150° C. and 300 mls of deionized water was added. The heterogeneous mixture was heated to reflux while vigorously stirring. A light tan oily precipitate was formed in the flask. The water was decanted. Then 300 mls of water was added and the water layer was again decanted. 300 mls of methanol was added and the mixture was refluxed to dissolve any unreacted starting materials. The solids were filtered off, added to 300 mls of n-octane and heated to a reflux temperature of 125° C. The solution was filtered through 100 grams of neutral Woelm alumina to give a pale yellow filtrate. The solution was again filtered through 100 grams of neutral Woelm alumina to yield a colorless filtrate and was allowed to cool yielding colorless crystals of the intended compound having a M.P. of 163°–164° C.

Analytical Calculation for $C_{38}H_{32}N_2$: C, 88.34, H, 6.24; N, 5.37. Found: C, 88.49; H, 6.44; N, 5.28.

NMR ($CDCl_3$) δ2.30 (s, 6, methyl); 6.93°–7.56 ppm (m, 26 aromatics).

EXAMPLE IV

Preparation of a Solution Employing the Compound of Example III

One gram of N,N'-diphenyl-N,N'-bis(4-methylphenyl)-[1,1'-biphenyl]4,4'-diamine was dissolved in 13.5 grams of methylene chloride containing 1.0 gram of Makrolon ®, a polycarbonate, to form a 50 percent by weight solution of the diamine in the polycarbonate.

EXAMPLE V

Preparation of N,N'-diphenyl-N,N'-bis(2-methylphenyl)-[1,1'-biphenyl]-4,4'-diamine Into a 250 milliliter, round bottom, 3 neck flask fitted with a mechanical stirrer, thermometer with temperature controller and a source of argon are placed 8.4 grams of N,N'-diphenyl-[1,1'-biphenyl]-4,4'-diamine (0.025 moles), 16.3 grams of 2-iodotoluene (0.075 moles), 7.5 grams copper bronze and 25 milliliters of a mixture of $C_{13}$–$C_{15}$ aliphatic hydrocarbons, i.e., Soltrol ®170, from Phillips Chemical Company. The contents of the flask are heated to 190° C. with stirring for a period of 18 hours. Using a water aspirator, the excess 2-iodotoluene is removed by vacuum distillation. The product is isolated by the addition of 200 milliliters of n-octane and hot filtration to remove the inorganic solids. The deep orange filtrate is column chromatographed using Woelm neutral alumina with cyclohexane/benzene in a 3:2 ratio as the eluent. The resulting oil is recrystallized from n-octane to yield colorless crystals of the intended compound having a melting point of 148°–150° C.

Analytical Calculation for $C_{38}H_{32}N_2$: C, 88.34; H, 6.24; N, 5.37. Found: C, 88.63; H, 6.25; N, 5.22.

NMR ($CDCl_3$) δ2.04 (s, 6, methyl); 6.84–7.44 ppm (m, 26, aromatics).

EXAMPLE VI

Preparation of N,N'-diphenyl-N,N'-bis(3-ethylphenyl)-[1,1'-biphenyl]-4,4'-diamine Into a 250 milliliter 3 necked round bottom flask equipped with a mechanical stirrer, thermometer with temperature controller and a source of argon are placed 8.4 grams of N,N'-diphenyl-[1,1'-biphenyl]-4,4'-diamine (0.025 moles), 13.8 grams of powdered potassium carbonate (0.1 moles), 17.4 grams of 3-ethyl iodobenzene (0.075 moles), 7.5 grams of copper bronze and 25 milliliters of a mixture of $C_{13}$–$C_{15}$ aliphatic hydrocarbons, i.e., Soltrol ®170, from Phillips Chemical Company. The contents of the flask are heated to 190° C. for 18 hours. Using a water aspirator, the excess 3-ethyl iodobenzene is removed by vacuum distillation. The product is isolated by the addition of 20 milliliters of n-octane and hot filtration to remove the inorganic solids. The deep orange filtrate is column chromatographed using Woelm neutral alumina with cyclohexane/benzene in the rato of 3:2 as eluent. The resulting oil is recrystallized from methanol and dried to yield pale yellow crystals of the intended product having a melting point of 62°–69° C.

Analytical Calculation for $C_{40}H_{36}N_2$: C, 88.20; H, 6.66; N, 5.14. Found: C, 88.37; H, 6.71; N, 5.03.

NMR ($CDCl_3$) δ1.17 (t, 6, methyl); 2.65 (q, 4, methylene); 6.92–7.53 ppm (m, 26, aromtics).

EXAMPLE VII

Preparation of N,N'-diphenyl-N,N'-bis(4-ethylphenyl)-[1,1'-biphenyl]-4,4'-diamine Into a 250 milliliter 3 necked round bottom flask equipped with a mechanical stirrer, thermometer with temperature controller and a source of argon are placed 8.4 grams of N,N'-diphenyl-[1,1'-biphenyl]-4,4'-diamine (0.025 moles), 13.8 grams of powdered potassium carbonate (0.1 moles), 17.4 grams of 4-ethyl iodobenzene (0.075 moles), 7.5 grams of copper bronze and 25 milliliters of a mixture of $C_{13}$–$C_{15}$ aliphatic hydrocarbons, i.e. Soltrol ®170, from Phillips Chemical Company. The contents of the flask are heated to 190° C. for 18 hours. Using a water aspirator, the excess 4-ethyl iodobenzene is removed by vacuum distillation. The product is isolated by the addition of 200 milliliters of n-octane and hot filtration to remove the inorganic solids. The deep orange filtrate is column chromatographed using Woelm neutral alumina with cyclohexane/benzene in a ratio of 3:2 as eluent. The resulting oil is recrystallized from octane to yield pale yellow crystals of the intended product having a melting point of 149°–151° C.

Analytical Calculation for $C_{40}H_{36}N_2$: C, 88.20; H, 6.66; N, 5.14. Found: C, 88.27; H, 6.72; N, 4.98.

NMR ($CDCl_3$) δ1.22 (t, 6, methyl); 2.60 (q, 4, methylene); 6.86–7.64 ppm (m, 26, aromatics).

EXAMPLE VIII

Preparation of N,N'-diphenyl-N,N'-bis(4-n-butylphenyl)-[1,1'-biphenyl]-4,4'-diamine Into a 250 milliliter 3 neck round bottom flask equipped with a mechanical stirrer, thermometer with temperature controller and a source of argon are placed 8.4 grams of N,N'-diphenyl-[1,1'-biphenyl]-4,4'-diamine (0.025 moles), 13.8 grams of powdered potassium carbonate (0.1 moles), 19.5 grams of 4-n-butyl iodobenzene (0.075 moles), 7.5 grams copper bronze and 25 milliliters of $C_{13}$–$C_{15}$ aliphatic hydrocarbons, i.e. Soltrol ®170, from the Phillips Chemical Company. The contents of the flask are heated to 190° C. with stirring for a period of 18 hours. The product is isolated by the addition of 200 milliliters of n-octane and hot filtration to remove the inorganic solids. The deep orange filtrate is column chromatographed using Woelm neutral alumina with cyclohexane/benzene in a ratio of 3:2 as eluent. The resulting viscous oil is recrystallized from octane to yield pale yellow crystals of the intended product having a melting point of 130°–132° C.

Analytical Calculation for $C_{44}H_{44}N_2$: C, 87.96; H, 7.38; N, 4.66. Found: C, 88.34; H, 7.30; N, 4.41.

NMR ($CDCl_3$) δ0.93 (t, 6, methyl); 1.15–1.78 (m, 8, methylene) 2.57 (t, 4, methylene); 6.50–7.58 ppm (m, 26, aromatics)

EXAMPLE IX

Preparation of N,N'-diphenyl-N,N'-bis(3-chlorophenyl)-[1,1'-biphenyl]-4,4'-diamine Into a 250 milliliter three-necked round bottom flask equipped with a mechanical stirrer, thermometer with temperature controller and a source of argon gas are placed 3.4 grams of N,N'-diphenyl-[1,1'-biphenyl]-4,4'-diamine (0.01 moles), 5.6 grams of potassium carbonate (0.04 moles), 9.6 grams of 3-chloroiodobenzene (0.04 moles) and 0.5 grams of copper powder. The contents of the flask are heated with stirring for a period of 24 hours. Using a water aspirator, the excess 3-chloroiodobenzene is removed by vacuum distillation. The product is isolated by the addition of 200 milliliters n-octane and hot filtration to remove the inorganic solids. The deep orange filtrate is column chromatographed using Woelm neutral alumina with cyclohexane/benzene as eluent (3/2). The resulting oil is recrystallizd from n-octane to yield colorless crystals of the intended product having a melting point of 130°–132° C.

EXAMPLE X

Preparation of N,N'-diphenyl-N,N'-bis(4-chlorophenyl)-[1,1'-biphenyl]-4,4'-diamine Into a 250 milliliter three-necked round bottom flask equipped with a mechanical stirrer, thermometer with temperature controller and a source of non-oxidizing gas are placed 3.4 grams of N,N'-diphenyl-[1,1'-biphenyl]-4,4'-diamine (0.01 mole), 5.6 grams potassium carbonate (0.04 mole), 9.6 grams of 4-chloroiodobenzene (0.04 mole) and 0.5 grams copper powder. The contents of the flask are heated with stirring for a period of 24 hours. Using a water aspirator, the excess 4-chloroiodobenzene is removed by vacuum distillation. The product is isolated by the addition of 200 milliliters n-octane and hot filtration to remove the inorganic solids. The deep orange filtrate is column chromatographed using Woelm neutral alumina with cyclohexane/benzene as eluent (3/2). The resulting oil is recrystallized from n-octane to yield colorless crystal of the intended product having a melting point 147°–149° C.

EXAMPLE XI

Preparation of Solutions Employing the Compounds of Examples V Through X

Six photoreceptor devices were prepared employing the compounds prepared in Examples V–X in the transport layers. Six solutions were prepared, each containing 1 gram of Makrolon ®, a polycarbonate, dissolved in 13.5 grams of methylene chloride. Into each solution was dissolved 1 gram of compounds prepared in Examples V–X to form a 50 percent by weight solid solution of the compound in the polycarbonate after the methylene chloride is removed.

EXAMPLE XII

Preparation of N,N,N',N'-tetraphenyl-[1,1'-phenyl]-4,4'-diamine

This compound is disclosed in Fox U.S. Pat. No. 3,265,496)

A 500 ml three necked round bottom flask equipped with a magnetic stirrer and purged with argon was charged 20 grams p,p'-diiodo biphenyl (0.05 mole), 16.9 grams diphenylamine (0.1 mole), 20.7 grams potassium carbonate (anhydrous) (0.15 mole), 3 grams copper powder and 50 mls sulfolane (tetrahydrothiophene-1,1-dioxide). The mixture was then heated to 220°–225° C. for 24 hours, allowed to cool to approximately 150° C. and 300 mls of deionized water was added. The hetrogeneous mixture was heated to reflux while vigorously stirring. A dark grey almost solid precipitate was formed. The water was decanted. Then 300 mls of water was added and the water layer was again decanted. 300 mls of methanol was added and the mixture was refluxed while stirring to remove unreacted starting materials. The solids were filtered off, dissolved in 300 mls of benzene and refluxed until the vapor temperature reached 80° C. The solution was filtered while hot through 75 grams neutral Woelm alumina to give an orange/yellow filtrate. 200 mls of ethanol was added and the solution allowed to cool. An orange crystalline solid material was filtered off and dissolved in 300 mls of benzene and column chromatographed using neutral Woelm alumina (500 grams) with benzene as the eluent. A colorless product was collected and extracted with 300 mls of acetone to yield colorless fine crystals with a M.P. of 230°–231° C.

Analytical Calculation for $C_{36}H_{28}N_2$: C, 88.49; H, 5.78; N, 5.73. Found: C, 88.79; H, 5.89; N, 5.43.

NMR ($CDCl_3$) δ6.91–7.49 (m, aromatics).

EXAMPLE XIII

Preparation of Photoreceptor Devices Employing the Compound of Example XII

Two separate combinations were made of this compound, i.e., N,N,-N',N'-tetraphenyl-[1,1'-biphenyl]-4,4'-diamine with a methylene chloride solution of Makrolon ® polycarbonate. The first combination produced a 15 percent by weight solution of this compound in the polycarbonate after removal of the methylene chloride, i.e. 0.177 grams of the compound of Example VII in 1.0 grams of polycarbonate. This was the maximum amount that could be dissolved in the polycarbonate.

The second combination produced a dispersion or incomplete solution of 20 percent by weight of the compound in the same polycarbonate after removal of the methylene chloride, i.e., 0.25 gram of the compound in 1.0 gram of the polycarbonate. Transport layers coated from this dispersion showed numerous white areas greater than 1 micron in size. These white areas indicate that the compound of U.S. Pat. No. 3,265,496 crystallized from the matrix.

EXAMPLE XIV

Preparation of A Photosensitive Member Having a Conductive Layer, Barrier Layer, Generation Layer, and Transport Layer An epoxy phenolic barrier layer about 0.5 micron thick is formed on a 3 mil aluminum substrate by dip coating. A 1 micron layer of amorphous selenium is then vacuum evaporated on the coated aluminum substrate by a conventional vacuum deposition technique such as the technique disclosed in by Bixby in U.S. Pat. No. 2,753,278 and 2,970,906.

Thus, vacuum deposition is carried out at a vacuum of $10^{-6}$ Torr while the substrate is maintained at a temperature of about 50° C. during the vacuum deposition. A charge transport layer is prepared by dissolving 10 milliliters of methylene chloride, 0.67 grams of bis(4-diethylamino-2-methyl phenyl) phenyl methane and 1.0 gram of Makrolon ®, a bisphenol-A-polycarbonate. A layer of this mixture is formed on amorphous selenium layer using a Bird film applicator. The coating is then vacuum dried at 40° C. for 18 hours to form a 22 micron thick dry layer of the charge transport material. The plate is tested for its photoconductive property by first negatively corona charging to a field of 50 volts/micron and exposing to a blue light flash of 4330 A° wavelength, 2 microseconds duration and 25 ergs/cm$^2$ light intensity. The device discharges to a very low potential of less than 50 volts indicating good photoconductive properties.

EXAMPLE XV

Preparation of a Member Having the Same Conductive Layer, Transport Layers, and Generator Layer, Materials Employed in Example XIV A 22 micron thick transport layer of 40 percent by weight of bis(4-diethylamino-2-methyl phenyl) phenyl methane in polycarbonate is solvent coated on an aluminum substrate. The coating is then vacuum dried at 40° C. for 18 hours. A 1 micron thick layer of amorphous selenium is vacuum deposited on top of the transport layer employing the same procedure as in Example XIV. This member is positively corona charged to a field of 50 volts/micron and exposed to a blue flash light of 4330 A° wavelength, 2 microseconds duration and 25 ergs/cm$^2$ light intensity. The exposure to this light results in a very low discharge of less than 150 volts (discharged from an initial potential of 1150 volts to 1000 volts). An enormous light exposure (greater than 2500 ergs/cm$^2$) is required to discharge this member to low potentials. This light flux value is much to high. A comparison of the results in Examples XIV and XV indicate that with the same material combination of a generator layer of amorphous selenium and a transport layer of bis(4-diethylamino-2-methylphenyl) phenyl methane in polycarbonate, the structure in Example XIV performs efficiently where as the structure of Example XV requires a light value of greater than 2,500 ergs/cm$^2$ which is too high to be useful in xerographic applications.

EXAMPLE XVI

Preparation of a Photosensitive Member Having a Conductive Layer, Transport Layer, and a Generator Layer A 22 micron thick transport layer containing 40 percent by weight of N,N'-diphenyl-N,N'-bis(3-methyl phenyl)-[1,1'-biphenyl]-4,4'-diamine dispersed in Makrolon ® is coated on an aluminum substrate employing methylene chloride as the solvent. The transport layer is heated at 40° C. for 18 hours. A 1 micron thick amorphous selenium film is vapor deposited on top of the transport layer employing the procedure of Example XIV. The member is positively corona charged to a field of 50 volts/micron and is exposed to a flash light of 4330 A° wavelength, 2 microseconds duration and 25 ergs/cm$^2$ light intensity. The member discharges to zero volts almost instantly. The member when subjected to a cyclic operation of charge, exposure and erase is stable even after 10,000 cycles of continuous operation in a scanner. Excellent quality prints are produced on a Xerox Corporation model D Processor employing this photosensitive member.

EXAMPLE XVII

Preparation of a Photosensitive Member Having a Conductive Layer, a Transport Layer and a Generator Layer An aluminum substrate is coated with a 22 micron thick transport layer of 40 percent by weight of N,N'-diphenyl-N,N'-bis(3-methylphenyl)-[1,1'-biphenyl]-4,4'-diamine dispersed in Makrolon ®, a polycarbonate, employing methylene chloride as the solvent. The layer is evacuated at 40° C. for 18 hours. Approximately 0.1 micron thick layer of an amorphous selenium alloy containing 35.5 percent by weight of arsenic and 64.5 percent by weight of selenium is vapor deposited with the substrate held at room temperature. The photosensitive member is corona charged using a positive corona to a field of 50 volts/micron and exposed to an unfiltered xenon flash source of 2 microseconds duration and 25 ergs/cm$^2$ light intensity. The member discharges instantly to essentially zero volts. The member is then subjected to a cyclic operation of charge-expose and erase cycles in a scanner and is found to be stable even after 50,000 cycles of essentially continuous operation.

Other modifications of the present invention will occur to those skilled in the art upon a reading of the present disclosure. These are intended to be included within the scope of the present invention.

What is claimed is:

1. An imaging member comprising a charge generation layer comprising a layer of photoconductive material, a contiguous charge transport layer, and an electrically conductive layer, said charge transport layer comprising a polycarbonate resin material having a molecular weight of from about 20,000 to about 120,000 having dispersed therein from about 25 to about 75 percent by weight of one or more compounds having the general formula:

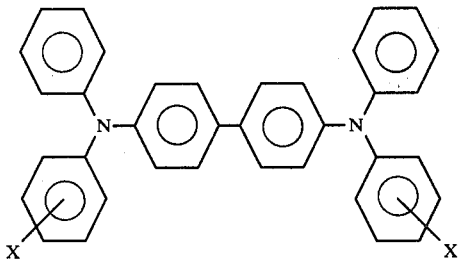

wherein X is selected from the group consisting of an alkyl group, having from 1 to about 4 carbon atoms and chlorine, said photoconductive layer exhibiting the capacity of photogeneration of holes and injection of said holes and said charge transport layer being capable of supporting the injection of photogenerated holes from said photoconductive layer and transporting said holes through said charge transport layer to said electrically conductive layer.

2. The member of claim 1 wherein the polycarbonate is poly(4,4'-isopropylidene-diphenylene carbonate).

3. The member according to claim 2 wherein the polycarbonate has a molecular weight between from about 25,000 to about 45,000.

4. The member according to claim 2 wherein the polycarbonate has a molecular weight of from about 50,000 to about 120,000.

5. The member of claim 1 wherein the charge generation layer comprises at least one layer of photoconductive material selected from the group consisting of amorphous selenium and amorphous selenium alloys selected from the group consisting of selenium-tellurium, selenium-tellurium-arsenic, selenium-arsenic, selenium-arsenic-halogen, and mixtures thereof.

6. The member of claim 4 wherein the charge generation layer comprises at least one layer of photoconductive material selected from the group consisting of amorphous selenium and amorphous selenium alloys selected from the group consisting of selenium-tellurium, selenium-tellurium-arsenic, selenium-arsenic, selenium-arsenic-halogen, and mixtures thereof.

* * * * *